United States Patent [19]

Newkirk et al.

[11] 4,259,405

[45] Mar. 31, 1981

[54] SYNTHETIC FIBERS LUBRICATED WITH HETERIC COPOLYMER OF TETRAHYDROFURAN AND $C_3$ TO $C_4$ ALKYLENE OXIDE

[75] Inventors: David D. Newkirk, Beaverton, Oreg.; Basil Thir, Grosse Ile, Mich.

[73] Assignee: BASF Wyandotte Corporation, Wyandotte, Mich.

[21] Appl. No.: 112,379

[22] Filed: Jan. 15, 1980

[51] Int. Cl.[3] ..... B32B 27/34; B32B 27/36; B05D 3/02

[52] U.S. Cl. ..... 428/395; 252/8.9; 260/410.6; 427/389.9; 428/361; 528/355; 568/617; 568/623

[58] Field of Search ..... 427/389.9, 394; 252/8.9; 428/361, 394, 395; 568/617, 623; 528/355; 260/410.6

[56] References Cited

U.S. PATENT DOCUMENTS

| | | | |
|---|---|---|---|
| 3,194,772 | 7/1965 | Trotz | 528/355 |
| 3,425,999 | 2/1969 | Axelrood et al. | 528/355 |
| 3,834,935 | 9/1974 | Symm et al. | 428/361 |
| 4,038,296 | 7/1977 | Greif et al. | 260/410.6 |
| 4,118,326 | 10/1978 | Login | 427/394 X |

FOREIGN PATENT DOCUMENTS

| | | | |
|---|---|---|---|
| 52-67164 | 1/1977 | Japan . | |
| 854958 | 11/1960 | United Kingdom | 568/617 |

*Primary Examiner*—Michael R. Lusignan
*Attorney, Agent, or Firm*—Andrew E. Pierce

[57] ABSTRACT

There are disclosed lubricated synthetic yarn and processes therefore wherein heteric copolymers of tetrahydrofuran and at least one $C_3$ to $C_4$ alkylene oxide initiated with a polyhydric alcohol are utilized as lubricants. The copolymers have a molecular weight of about 500 to about 10,000 and are initiated with polyhydric alcohols having a total of not more than 20 carbon atoms which are free of elements other than carbon, hydrogen and oxygen. Said initiators have 2 to about 6 reactive hydrogen atoms. The heteric copolymers of the invention capped with at least one lower alkylene oxide residue are also useful as fiber lubricants.

18 Claims, No Drawings

SYNTHETIC FIBERS LUBRICATED WITH HETERIC COPOLYMER OF TETRAHYDROFURAN AND $C_3$ TO $C_4$ ALKYLENE OXIDE

BACKGROUND OF THE INVENTION

1. Field of the Invention

This invention relates to the processing of multifilament synthetic yarns, particularly polyester and nylon yarn, with fiber lubricants which are applied as spinfinishes subsequent to the extrusion of the fibers from the spinneret.

2. Description of the Prior Art

In the production of polyester and polyamide yarn, a lubricant is applied as a coating to the yarn after extrusion of the fibers. The lubricant is essential in order that the subsequent processing of the yarn can take place. The yarn is subsequently subjected to a texturing process in which the fibers are stretched or bulked after being heated such as by contact with a heated metal plate. In addition to lubricity properties required to avoid breaking the fibers during such processing, relatively high oxidation stability is required to avoid excessive oxidative degradation of the fiber lubricants applied to the yarn upon exposure to the temperatures encountered during this processing operation. Complete volatiization of the fiber lubricant which contacts the heated metal plate is desirable.

It is known to utilize polyoxyalkylene compounds as fiber lubricants to prevent fiber breakage during pin or disk texturing processes. Such polyoxyalkylene compounds including heteric polyoxyalkylene compounds derived from the random polymerization of polytetramethylene oxide (tetrahydrofuran) with either ethylene oxide or 1,2-propylene oxide and utilizing a monohydric alcohol as an initiator are known from Tanizaki et al, Japanese Patent Announcement No. 213-1977. Tanizaki et al teach away from the use of polyhydric alcohols as initiators in the preparation of said polyoxyethylene compound fiber lubricants. The preparation of heteric copolymers of tetrahydrofuran and a lower alkylene oxide is known from U.S. Pat. No. 3,425,999 and British Patent No. 854,958 wherein both monohydric and polyhydric alcohol initiators are disclosed for use in the preparation of the copolymers. In U.S. Pat. No. 4,038,296, there are disclosed heteric copolymers of said monomers prepared using monohydric alcohol initiators.

Ethylene oxide capped heteric copolymers of tetrahydrofuran and ethylene oxide are disclosed in copending application Ser. No. 909,879, filed May 26, 1978, now U.S. Pat. No. 4,198,464, and fiber lubricants prepared by the block polymerization of tetrahydrofuran and ethylene oxide are disclosed in copending application, Ser. No. 909,880, filed May 26, 1978. Block copolymers of ethylene oxide and butylene oxide are disclosed in U.S. Pat. No. 3,834,935.

SUMMARY OF THE INVENTION

It is a primary object of this invention to provide to the art lubricated synthetic fibers and a process therefore wherein said fibers comprise synthetic fibers such as polyester, polyamide, and polyacrylic fibers.

Accordingly, valuable polyether polyol fiber lubricants are obtained by the heteric copolymerization of tetrahydrofuran with at least one $C_3$ to $C_4$ alkylene oxide using a polyhydric alcohol initiator. In view of the teaching in the above-cited reference to Tanizaki et al, it is surprising that the heteric copolymers, for instance, of tetrahydrofuran and propylene oxide prepared utilizing a polyhydric alcohol initiator are suitable as fiber lubricants. Thus, in spite of the teaching by Tanizaki et al that such polyoxyalkylenes have poor viscosity properties, it has been found that the use of tetrahydrofuran to prepare a heteric copolymer with 1,2-propylene oxide, said copolymer initiated with a polyhydric alcohol, provides a copolymer having satisfactory low viscosity and lubricity. The oxidation stability is unexpectedly superior to the prior art fiber lubricants. The copolymers of the invention provide unexpectedly clean volatilization at elevated temperatures. A major proportion of the polyether polyol fiber lubricant can contain tetrahydrofuran moieties for increased oxidation resistance and lubricity. Lower alkylene oxide-capped, heteric copolymers of the invention are also useful as fiber lubricants. At least one lower alkylene oxide is utilized to provide said cap.

The lubricants of the invention have the formula:

$$Y[A]_x \text{ and } Y[(A)_m(B)_n]_x$$

wherein Y is the residue formed by the removal of x atoms of active hydrogen from an organic compound initiator preferably having a total of not more than 20 carbon atoms and free of elements other than carbon, hydrogen, and oxygen. The preferred initiators have 2 to 3 active hydrogen atoms and 2 to about 8 carbon atoms, most preferably 2 to about 4 carbon atoms. Representative polyhydric alcohol initiators are the alkylene glycols such as ethylene glycol, propylene glycol, and 1,4-butane diol, and polyalkylene glycols such as diethylene glycol, glycerol, pentaerythritol, sorbitol, and trimethylolpropane. A is a heteric mixture of $C_3$ to $C_4$ alkylene oxide and tetrahydrofuran residues derived from the reaction of said oxides and tetrahydrofuran in the respective ratio by weight of 1:99 to 99:1; B is at least one of a lower alkylene oxide selected from the group consisting of ethylene oxide, propylene oxide and butylene oxide; where mixed $C_2$ to $C_4$ alkylene oxide of monmers are utilized in the formation of B, any weight proportion of monoer is suitable; the proportion of A to B is 1:4 to 4:1 by weight; x is an integer of 2 to about 6; and m and n are such that the total molecular weight of the said compound is about 500 to about 10,000, preferably about 1000 to about 6000.

DETAILED DESCRIPTION OF THE INVENTION AND OF THE PREFERRED EMBODIMENTS

As is well known in the prior art, polyether polyol compounds can be produced by first reacting an initiator compound designated as Y in the formula above, said initiator having 2 to 6 active hydrogen atoms. By use of the term "active hydrogen atoms" it is intended to describe any compound which gives a positive Zerewitinoff test. The term active hydrogen atom is well known and clearly understood by those skilled in the art. However, to remove any possible ambiguity in this regard, the term active hydrogen atom, as used herein and in the appended claims, includes any hydrogen atom fulfilling the following two conditions:

(1) It is sufficiently labile to open the epoxide ring of 1,2-propylene oxide, and (2) It reacts with methyl magnesium iodide to liberate methane in the classical Zerewitinoff reaction (see Niederl and Niederl, Micromethods of Quantitative Organic Analysis, P. 263, John Wiley and Sons, New York City, 1946).

Generally, the heteric $C_3$ to $C_4$ alkylene oxidetetrahydrofuran copolymers of the invention are prepared by reacting a mixture of tetrahydrofuran and at least one $C_3$ to $C_4$ alkylene oxide with a polyhydric alcohol in the presence of a Lewis acid catalyst. As is well known to those skilled in the art, a Lewis acid is defined as any molecule or ion that can combine with another molecule or ion by forming a covalent bond with two electrons from the second molecule or ion. A Lewis acid is thus an electron acceptor. Many compounds in addition to the hydrogen ion exhibit this behavior, for instance, boron trifluoride and aluminum chloride. Further details of the preparation of the heteric copolymers of the invention can be found in Tanizaki et al, as cited above, incorporated herein by reference.

The lubricants of the invention can be applied in a lubricating amount to the surface of synthetic fibers to be lubricated in any convenient manner, for instance as oils upon dilution with a natural or synthetic oil which is a solvent or diluent for the polyether polyols of the invention or as aqueous dispersions or solutions at ambient temperatures. Since only a very small amount of lubircant is necessary on the fiber (generally about 0.1 percent by weight to about 1 percent by weight of lubricant being required based upon the weight of the fiber), it is generally most convenient to dilute the lubricant by dissolving or dispersing it in water. The lubricant can then be applied by a spray, immersion or other known prior art techniques. Because the polyether polyol lubricants of the invention are unexpectedly stable at the usual temperatures utilized in drawing and crimping synthetic fibers, conventional stabilizers and antioxidants are generally not required. However, where additional stability to oxidation is necessary, suitable antioxidant additives known in the prior art containing a hindered phenolic or aromatic amines group are useful. The antioxidant disclosed in U.S. Pat. No. 3,146,272 can also be used.

It is believed that the oxidative deterioration of polyoxyalkylene compounds is accompanied by the formation of carbonyl compounds, peroxides and acids and that the manifestation of such deterioration is often a decrease in viscosity, and the concordant formation of resinous by-products, as indicated by the residue formed after heating of the composition at elevated temperature. Thus, the tendency to form resinous deposits as opposed to clean volatilization of polyoxyalkylene textile lubricants upon their use at elevated temperatures such as about 200° C. is commonly utilized as an indicator of utility as a lubricant for yarns that pass over hot surfaces. Resinous deposits on the texturing machine heater plate can result in broken filaments. Transfer of these deposits to the yarn can result in uneven dying of fabrics made from such yarn.

The molecular weight of the polyether polyol heteric copolymer lubricants of the invention can be calculated from the hydroxyl number in accordance with the formula:

$$\text{Molecular weight} = \frac{56.1 \times 10^3 \times \text{number of hydroxyl groups}}{\text{hydroxyl number}}$$

The hydroxyl number of the polyether can be calculated as described in ASTM D-1638.

The following examples illustrate the preparation of the fiber lubricants of the invention. Where not otherwise specified throughout this specification and claims, temperatures are given in degrees centigrade and parts, percentages, and proportions are by weight.

EXAMPLE 1

The propylene oxide-tetrahydrofuran heteric copolymer-based fiber lubricants utilized in the treatment of synthetic fibers are obtained by preparing heteric copolymers in the presence of a Lewis acid catalyst and a polyhydric alcohol initiator. Generally, the procedure utilized for the preparation of the heteric copolymer is as follows:

To a round bottomed flask equipped with a stirrer, thermometer, and dry ice condensor which has been flushed with nitrogen, there were added 550 grams of tetrahydrofuran, 20.5 grams of ethylene glycol, 4.3 grams of borontrifluoride etherate catalyst, and 290 grams of 1,2-propylene oxide. The propylene oxide was added over a period of 5.5 hours at a temperature of 40°–45° C. The mixture was allowed to stand overnight and then neutralized with sodium carbonate and volatiles stripped off at 120°–130° C. at 3 millimeters of mercury pressure. A product was obtained in a yield of 654 grams with 177 grams of volatiles. Analysis indicated that the volatiles were mainly tetrahydrofuran. The hydroxyl number was used to calculate the molecular weight (1214). The polymer consisted of 43 percent by weight propylene oxide residue and 53 percent by weight tetrahydrofuran residue.

EXAMPLE 2

Following the procedure of Example 1, a heteric copolymer of 1,2-propylene oxide and tetrahydrofuran was prepared containing 40 percent propylene oxide and 56 percent tetrahydrofuran residues.

EXAMPLES 3, 4 & 5

Utilizing the polymer prepared in Example 1, a fiber lubricant of the invention is prepared having an ethylene oxide residue cap in the amount of 20 percent by weight of the total molecular weight of the polymer. Successively, a 1,2-propylene oxide and 1,2-butylene oxide caps in the amount of 20 percent by weight are added to the polymer of Example 1.

EXAMPLE 6

Utilizing the heteric copolymer prepared in Example 2, a mixture of ethylene oxide and 1,2-propylene oxide is utilized to add on a 20 percent by weight heteric cap. The final polymer obtained can be considered to be a heteric/heteric copolymer.

EXAMPLES 7–10

(control samples forming no part of this invention)

Examples 7 and 8 are polyether polyols representative of fiber lubricant polymers of the prior art. Example 7 is a block polymer consisting of 10 percent by weight ethylene oxide and 90 percent by weight propylene oxide residues having a molecular weight of 1100. Example 8 is a block polymer of 50 percent by weight ethylene oxide and 50 percent by weight 1,2-propylene oxide having a molecular weight of 1900.

Examples 9 and 10 are control samples prepared using ethylene oxide instead of propylene oxide to prepare heteric polymers useful as fiber lubricants. Example 9 is a heteric copolymer of 23 percent by weight ethylene oxide and 77 percent by weight tetrahydrofuran having a molecular weight of 2444. Example 10 is a heteric copolymer of 51 percent by weight ethylene oxide and 49 percent by weight tetrahydrofuran having a molecular weight of 2081.

In the following table, the oxidation resistance of the polyether polyol fiber lubricants of the invention is compared with the control polyether polyols. It should be noted that the polyether polyol fiber lubricants of the invention are markedly superior in clean volatilization over control samples 9 and 10 and generally comparable to the lubricants of Examples 7 and 8.

TABLE

Oxidation Resistance of Polyether Polyol Fiber Lubricants

| | % Residue after Heating at 240° C. (hours) | | | | | | |
|---|---|---|---|---|---|---|---|
| Example | ¼ | ½ | 1 | 2 | 4 | 5 | 24 |
| 1 | 61.3 | 45.7 | 22.6 | 12.5 | 9.6 | 8.5 | 5.4 |
| 2 | 81.6 | 62.9 | 19.5 | 10.1 | 7.9 | 7.3 | — |
| 7 control | 94.3 | 55.0 | — | — | — | — | — |
| 8 control | 82.1 | 50.6 | 16.6 | 8.0 | 5.4 | 2.8 | — |
| 9 control | 84.5 | 66.5 | 53.4 | 30.1 | 19.9 | 19.0 | 11.1 |
| 10 control | 91.8 | 82.1 | 61.9 | 43.3 | 32.8 | 32.0 | 19.8 |

While this invention has been described with reference to certain specific embodiments, it will be recognized that many variations are possible without departing from the scope and spirit of the invention.

The embodiments of this invention in which an exclusive privilege or property are shown are claimed as follows:

1. A lubricated synthetic textile yarn comprising a polyester, polyamide, or polyacrylic fiber or mixtures thereof and present on the surface thereof, a lubricating amount of an oxyalkylene compound of the formula:

$$Y[A]_x$$

wherein Y is the residue formed by the removal of x atoms of active hydrogen from an organic compound initiator having a total of not more than 20 carbon atoms and free of elements other than carbon, hydrogen, and oxygen; A is a heteric mixture of at least one $C_3$ to $C_4$ alkylene oxide and tetrahydrofuran residues derived from the reaction of (1) tetrahydrofuran and (2) at least one of propylene oxide or butylene oxide in the respective ratio by weight of (1) to (2) of 1:99 to 99:1; and x is an integer of 2 to about 6; and wherein the total molecular weight of said compound is about 500 to about 10,000.

2. The lubricated fiber of claim 1 wherein Y is the residue of a $C_2$ to $C_8$ polyhydric alcohol.

3. The lubricated fiber of claim 2 wherein said polyhydric alcohol is selected from the group consisting of ethylene glycol, diethylene glycol, propylene glycol, 1,4-butane diol, glycerol, trimethylolpropane, pentaerythritol, and sorbitol.

4. The lubricated fiber of claim 3 wherein said polyhydric alcohol is ethylene glycol, and $C_3$ to $C_4$ alkylene oxide is propylene oxide, said oxyalkylene compound has a molecular weight of about 1000 to about 6000 and said lubricating amount of oxyalkylene compound is about 0.1 percent by weight to about 1 percent by weight based upon the weight of said fiber.

5. In a process for lubricating synthetic textile fibers with an oxyalkylene compound fiber lubricant, the improvement wherein a polyether polyol is applied in a lubricating amount to said fibers from an aqueous dispersion wherein said polyether polyol is a compound having the formula:

$$Y[A]_x$$

wherein Y is the residue formed by the removal of x atoms of active hydrogen from an organic compound initiator having a total of not more than 20 carbon atoms and free of elements other than carbon, hydrogen, and oxygen; A is a heteric mixture of (1) tetrahydrofuran and (2) at least one $C_3$ to $C_4$ alkylene oxide residue derived from the reaction of tetrahydrofuran and at least one of propylene oxide or butylene oxide in the respective ratio by weight of (1) to (2) of 1:99 to 99:1; x is an integer of 2 to about 6; and the total molecular weight of said oxyalkylene compound is about 500 to about 10,000.

6. The process of claim 5 wherein Y is the residue of a $C_2$ to $C_8$ polyhydric alcohol.

7. The process of claim 6 wherein said polyhydric alcohol initiator is selected from the group consisting of ethylene glycol, diethylene glycol, propylene glycol, 1,4-butane diol, glycerol, trimethylolpropane, pentaerythritol, and sorbitol.

8. The process of claim 7 wherein said synthetic fibers are selected from the group consisting of polyester, polyamide, and polyacrylic fibers.

9. The process of claim 8 wherein said oxyalkylene compound is derived from the reaction of 1,2-propylene oxide and said tetrahydrofuran.

10. The process of claim 8 wherein said oxyalkylene compound initiator is ethylene glycol and said oxyalkylene compound has a molecular weight of about 1000 to about 6000.

11. A lubricated synthetic textile fiber comprising a polyester, polyamide, or polyacrylic fiber or mixtures thereof and present on the surface thereof, a lubricating amount of an oxyalkylene compound of the formula:

$$Y[(A)_m(B)_n]_x$$

wherein Y is the residue formed by the removal of x atoms of active hydrogen from an organic compound initiator having a total of not more than 20 carbon atoms and free of elements other than carbon, hydrogen, and oxygen; A is a heteric mixture of tetrahydrofuran residues and at least one $C_3$ to $C_4$ alkylene oxide residue derived from the reaction of tetrahydrofuran and said oxides in the respective ratio by weight of 1:99 to 99:1; B is at least one of a lower alkylene oxide selected from the group consisting of ethylene oxide, propylene oxide, and butylene oxide; x is an integer of 2 to about 6; and wherein m and n are such that the total molecular weight of said compound is about 1000 to about 10,000.

12. The lubricated fiber of claim 11 wherein Y is the residue of a $C_2$ to $C_8$ polyhydric alcohol.

13. The lubricated fiber of claim 12 wherein said polyhydric alcohol is selected from the group consisting of ethylene glycol, diethylene glycol, propylene glycol, 1,4-butane diol, glycerol, trimethylolpropane, pentaerythritol, and sorbitol.

14. The lubricated fiber of claim 13 wherein said polyhydric alcohol is ethylene glycol, said $C_3$ to $C_4$ alkylene oxide in A is 1,2-propylene oxide, said oxyalkylene compound has a molecular weight of about 1000 to about 6000, and said lubricating amount of oxyalkylene compound is about 0.1 percent by weight to about 1 percent by weight based upon the weight of said fiber.

15. In a process for lubricating synthetic textile fibers with a oxyalkylene compound fiber lubricant, the improvement wherein a polyether polyol is applied in a lubricating amount to said fibers from an aqueous dispersion wherein said polyether polyol is a compound having the formula:

$$Y[(A)_m(B)_n]_x$$

wherein Y is the residue formed by the removal of x atoms of active hydrogen from an organic compound initiator having a total of not more than 20 carbon atoms and free of elements other than carbon, hydrogen, and oxygen; A is a heteric mixture of tetrahydrofuran residues and at least one $C_3$ to $C_4$ alkylene oxide residue derived from the reaction of tetrahydrofuran and said oxides in the respective ratio by weight of 1:99 to 99:1; B is at least one of a lower alkylene oxide selected from the group consisting of ethylene oxide, propylene oxide, and butylene oxide; x is an interger of 2 to about 6; and wherein m and n are such that the total molecular weight of said oxyalkylene compound is about 500 to about 10,000.

16. The process of claim 15 wherein y is the residue of a $C_2$ to $C_8$ polyhydric alcohol.

17. The process of claim 16 wherein said polyhydric alcohol initiator is selected from the group consisting of ethylene glycol, diethylene glycol, propylene glycol, 1,4-butane diol, glycerol, trimethylolpropane, pentaerythritol, and sorbitol.

18. The process of claim 17 wherein said synthetic fibers are selected from the group consisting of polyester, polyamide, and polyacrylic fibers and wherein said polyether is derived from the reaction of said 1,2-propylene oxide and said tetrahydrofuran in A with ethylene oxide in B and wherein as said initiator is ethylene glycol and said lubricant has a molecular weight of about 1000 to about 6000.

* * * * *